United States Patent [19]

Tarumi et al.

[11] 4,256,822

[45] Mar. 17, 1981

[54] ELECTROPHOTOGRAPHIC PLATE CONTAINING QUATERNARY AMMONIUM SALT POLYMER INTERLAYER

[75] Inventors: Noriyoshi Tarumi; Akihiko Tamura; Masakazu Kokiso, all of Hachioji; Toshio Muramatsu; Koichi Nagayasu, both of Hino, all of Japan

[73] Assignee: Konishiroku Photo Industry Co., Ltd., Tokyo, Japan

[21] Appl. No.: 69,073

[22] Filed: Aug. 23, 1979

Related U.S. Application Data

[63] Continuation of Ser. No. 818,311, Jul. 25, 1977, abandoned, which is a continuation-in-part of Ser. No. 631,521, Nov. 13, 1975, abandoned.

[30] Foreign Application Priority Data

Nov. 16, 1974 [JP] Japan ..... 49-132432

[51] Int. Cl.[3] ..... G03G 5/14

[52] U.S. Cl. ..... 430/62; 430/60; 428/461; 428/483

[58] Field of Search ..... 430/60, 62; 428/461, 428/483, 510, 514

[56] References Cited

U.S. PATENT DOCUMENTS

| | | | |
|---|---|---|---|
| 2,937,944 | 5/1960 | Van Dorn et al. | 430/69 |
| 3,798,032 | 3/1974 | Miller | 430/62 |
| 3,813,264 | 5/1974 | Boothe et al. | 430/62 X |
| 3,870,559 | 3/1975 | Cowling et al. | 430/62 X |
| 3,991,256 | 11/1976 | Cornier et al. | 430/62 X |

*Primary Examiner*—Roland E. Martin, Jr.
*Attorney, Agent, or Firm*—James E. Nilles

[57] ABSTRACT

An electrophotography photosensitive plate having an interfacelayer between a substrate and a photosensitive layer. Said interfacelayer comprises the mono- or copolymer of the unit components represented by the general formula:

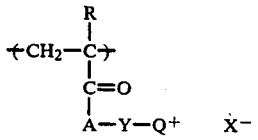

In said formula R is a hydrogen atom or a methyl group; A is

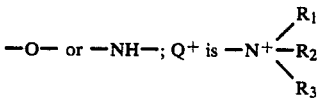

wherein $R_1$, $R_2$ and $R_3$ each are lower alkyl, phenyl or benzyl groups, and further $R_2$ and $R_3$ may be taken together to form a ring, or

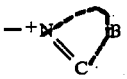

wherein B is a nonmetallic atom selected from the group consisting of carbon, nitrogen and sulfur atoms, necessary to form a 5-6 membered heterocycle nucleus with the —N+=C—; X− is an anion; and Y is a substituted or unsubstituted alkylene group.

6 Claims, No Drawings

ELECTROPHOTOGRAPHIC PLATE CONTAINING QUATERNARY AMMONIUM SALT POLYMER INTERLAYER

REFERENCE TO CO-PENDING APPLICATION

This is a continuation of application Ser. No. 818,311, filed July 25, 1977, now abandoned, which is a continuation-in-part of our pending United States patent application Ser. No. 631,521, filed Nov. 13, 1975, now abandoned, and entitled "An Electrophotography Photosensitive Plate".

The present invention relates to a repeatedly usable binder-type electrophotography photosensitive plate. Two ways of electrophotography are known in the art. In one way, an electrostatic image is formed on a photosensitive layer and developed to produce toner image which is in turn fixed on the layer. In the other way, a toner image produced on photosensitive layer is transferred to a transfer material and fixed thereon. In the latter way containing toner image transfer process, two types of photosensitive plates are used. One is that having an evaporated layer of selenium as material of photosensitive layer, and the other is a binder-type photosensitive plate the photosensitive layer of which is formed by dispersing photoconductive powders of zinc oxide, cadmium sulfide, cadmium selenide, cadmium sulfide selenide, zinc sulfide or the like in a binder consisting of an insulating high molecular material.

Recently, binder-type photosensitive plates have been substituting for selenium-based photosensitive plates since the former is relatively easily prepared only by applying dispersions of photoconductive powders in high molecular binders on substrates. These binder-type photosensitive plates, however, have drawbacks in that their photosensitive layers are apt to become electrically uneven because the photoconductive particle are dispersed in binder such as insulated resin, and thus the photosensitive layer are subject to partial breakdown due to repeated corona discharge and exposure to light, resulting in the copied images with many white spots.

In the prior art to obviate the above drawbacks, a hydrophilic or lipophilic interfacelayer is conventionally provided between a conductive substrate and a photosensitive layer. The hydrophilic interfacelayer materials include, for example, polyvinyl alcohol, carboxy methyl cellulose, casein, gelatin, starch and the like. Ethyl cellulose, polyvinyl butyral, vinyl acetate or epoxy resin is used as the lipophilic interfacelayer. Among the materials used to form this interfacelayer, the hydrophilic materials have been preferably used for the reason that they do not penetrate into a photosensitive layer when the layer is coated on materials. But, when the hydrophilic materials are placed in a dry atmosphere to be dried, their electric properties are impaired and they cause inferior image with fog, while in a humid atmosphere they absorb water and can exert sufficient electric properties as interfacelayer. The hydrophilic materials are not satisfactory yet for the reason that their physical properties such as their flexibility, film forming ability and adhesive ability for substrates or photosensitive layers are influenced by humidity. As to the lipophilic materials, they generally have not preferable electric properties as interfacelayer, cause production of poor quality of images because they apt to cause fog, and also cause changes in properties of interfacelayer and the photosensitive layer in case photosensitive layer is organic binder-type, because the interfacelayer and the organic binder materials used in photosensitive layer are dissolved each other into the solvent at the interface between photosensitive layer and interfacelayer.

An object of the present invention is to provide an electrophotography photosensitive plate without the abovereferred drawbacks of the prior art, namely that in which the electric and physical properties do not change even in a dry atmosphere and can produce copied images of excellent quality.

A further object of the present invention is to provide an electrophotography photosensitive plate which does not cause fatigue and degeneration of quality of copied images even in repeated copying in repeated transfer type electrophotography.

A still further object of the present invention is to provide an electrophotography photosensitive plate in which the electric and physical properties of its interfacelayer are not impaired by the high temperature treatment of about 100° C., at which a curing of the photosensitive layer on the interfacelayer is necessary when the photosensitive layer is of thermosetting binder-type.

The inventors of the present invention have found that the foregoing objects of the invention can be accomplished by providing between the substrate and the photoconductive layer of an electrophotography photosensitive plate a layer comprising mono- or copolymer of the unit components represented by the general formula:

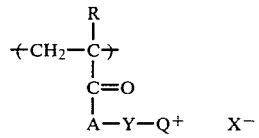

wherein R is a hydrogen atom or a methyl group; A is

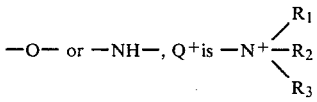

wherein $R_1$, $R_2$ and $R_3$ each are lower alkyl, phenyl or benzyl groups, and further $R_2$ and $R_3$ may be taken together to form a ring, or

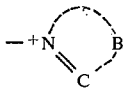

wherein B is a non-metallic atom selected from the group consisting of carbon, nitrogen and sulfur atoms, which is necessary to form a 5–6 membered heterocycle nucleus with the $-N^+=C-$; $X^-$ is an anion; and Y is a substituted or unsubstituted alkylene group.

Independent of surrounding humidity, the interfacelayer of the electrophotography photosensitive plate according to the present invention:

1. Prevents the so-called thunderbolt phenomena which is a locally strong discharge between a photosensitive layer and corona wire in the course of charging with a corona charger;

2. Prevents a photosensitive layer of a binder-type photosensitive plate from being spotted with many white spots which are apt to be produced when electrostatic charge pattern is subjected to toner development to produce visible images, since the layer tends to have electrically poor points on the surface when the layer is discontinuous dispersion layer;
3. Does not cause the deterioration of images in repeated transfer type electrophotography even when the images are produced by repeatedly using such a binder-type photosensitive plate as the above;
4. Moderates the electric unevenness of a photoconductive layer to produce less rough images, and thus improves the tone; and
5. Lowers the residual charge, and thus reduce fogging of images.

The interfacelayer of the present invention, when it lies on insulating substrate such as paper or plastic film, also functions as conductive layer in addition to functioning as interfacelayer if the unit components of the mono- or co-polymers contained in the interfacelayer and/or the polymerization degree are suitably selected.

Such interfacelayer is normally bonded to between conductive substrate and photosensitive layer, so that when the substrate is insulating, a conductive layer and the interfacelayer of the present invention are separately provided between the substrate and the layer.

If necessary, a barrier layer may be provided between the substrate and the photosensitive layer in addition to the interfacelayer of the present invention.

The following are representative structural formulae of the mono- or co-polymers based on the unit components of the previously shown general formula. In the formulae, n, $n_1$ and $n_2$ are average polymerization degrees, and $n_1$:$n_2$ is a molar ratio in polymerization.

1.

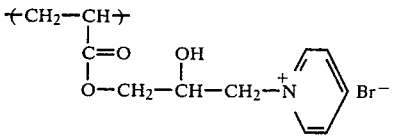

n = 230

2.

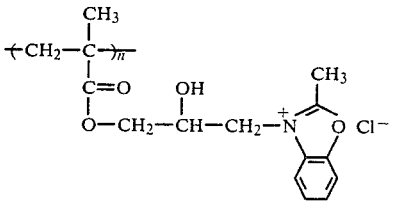

n = 150

3.

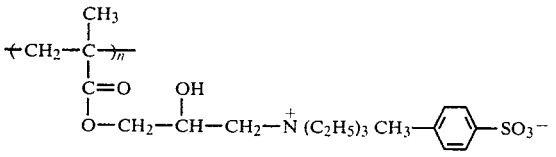

n = 110

-continued

4.

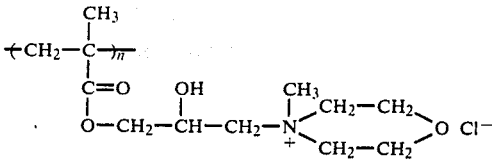

n = 130

5.

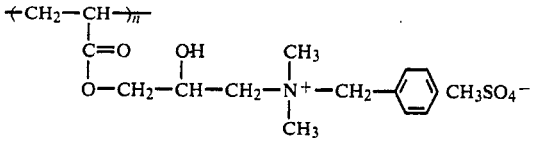

n = 280

6.

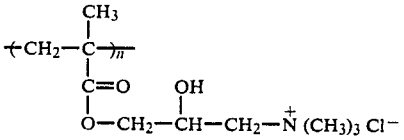

n = 350

7.

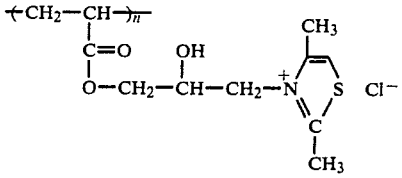

n = 250

8.

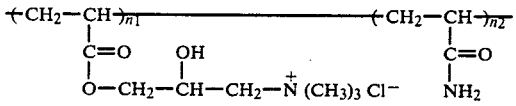

$n_1 + n_2 = 160$
$n_1 : n_2 = 2 : 1$

9.

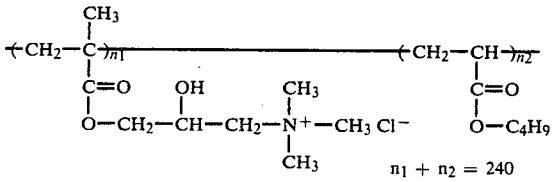

$n_1 + n_2 = 240$
$n_1 : n_2 = 1 : 1$

10.

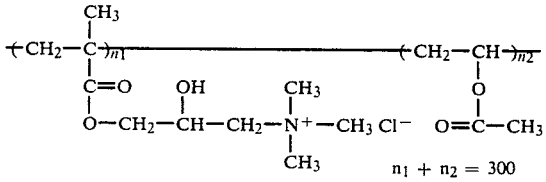

$n_1 + n_2 = 300$
$n_1 : n_2 = 1 : 1$

11.

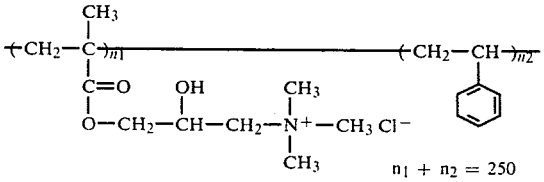

$n_1 + n_2 = 250$
$n_1 : n_2 = 1 : 1$

-continued

12.

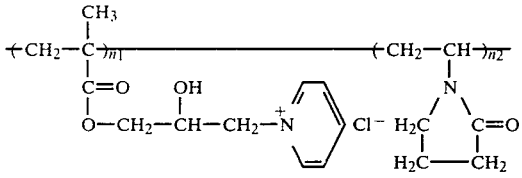

$n_1 + n_2 = 260$
$n_1 : n_2 = 3 : 1$

13.

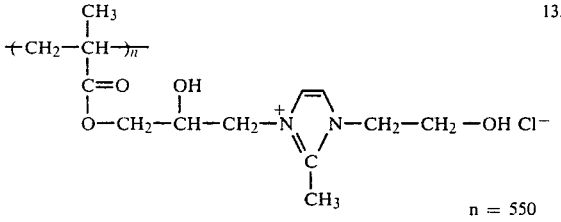

n = 550

14.

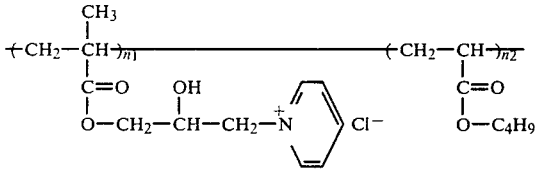

$n_1 + n_2 = 200$
$n_1 : n_2 = 1 : 4$

15.

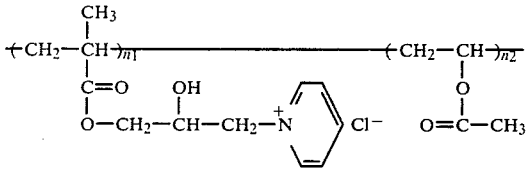

$n_1 + n_2 = 280$
$n_1 : n_2 = 4 : 6$

16.

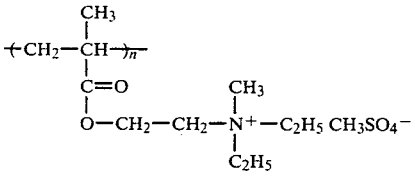

n = 480

17.

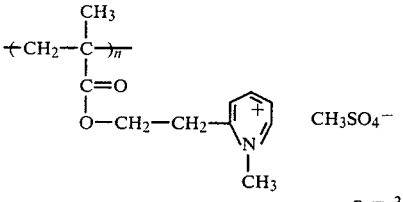

n = 320

18.

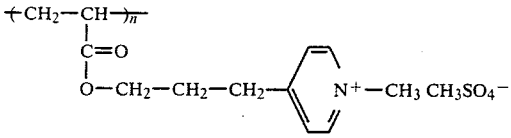

n = 270

-continued

19.

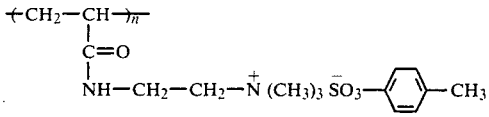

n = 290

20.

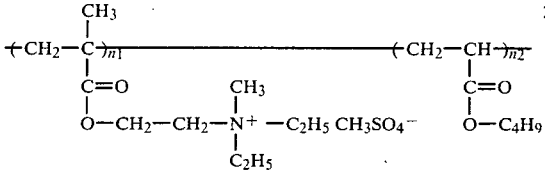

$n_1 + n_2 = 250$
$n_1 : n_2 = 2 : 3$

21.

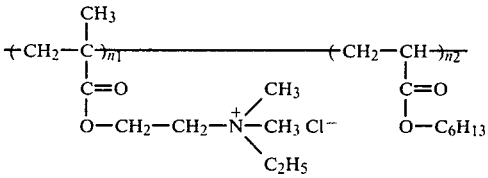

$n_1 + n_2 = 300$
$n_1 : n_2 = 3 : 7$

The materials for the interfacelayer of the present invention are not limited to mono-polymers of the above-mentioned unit components and include further co-polymers having the components copolymerized with vinyl monomers such as acrylamide, N-vinylpyrrolidone, N,N-dimethylacrylamide, diacetone acrylamide, methyl acrylate, methyl methacrylate, vinyl acetate, styrene or vinyl butyral.

The interfacelayer of the present invention may be formed of mixtures of the foregoing mono- or co-polymers and resins, compatible with them, such as mono- or co-polymers of acrylamide, N-vinylpyrrolidone, N,N-dimethylacrylamide, diacetone acrylamide, methyl acrylate, methyl methacrylate, vinyl acetate, styrene, vinyl butyral, ethyl cellulose, vinyl ether or the like.

In an example of a process to prepare the compounds useful as materials for the interfacelayer of the present invention, a minor portion of hydroquinone is added to a mixture of glycidyl methacrylate, trialkylamine hydrochloride or pyridine hydrochloride, and benzyl alcohol to synthesis a 2-hydroxy-3-trialkylaminopropyl methacrylate chloride or 2-hydroxy-3-pyridylpropyl methacrylate chloride. The thus produced quaternary ammonium salt compound is further reacted alone or with a vinyl monomer such as N-vinylpyrrolidone, acrylamide, alkyl methacrylate, alkyl acrylate or the like in a stream of nitrogen to yield the desired mono- or co-polymers.

Alternatively, the objective mono- or co-polymers are obtained by the following procedure. As an example, dimethyl sulfate or methyl chloride was added to an ethereal $\beta$-diethylaminoethyl methacrylate solution and then the resulting solution was kept in an ice-water bath for several hours to yield a viscous quaternary ammonium salt compound, $\beta$-methacryloxyethyl diethylmethyl ammonium methosulfate or $\beta$-methacryloxyethyl diethylmethyl ammonium chloride. The thus produced quaternary ammonium salt monomer or its mixture with other co-polymerizable vinyl monomer was subjected to a further reaction at about 60° C. overnight after addition of a polymerization initiator such as hydrogen peroxide to yield the desired mono- or co-polymers.

The following are to illustrate syntheses of the representatives of the above-mentioned polymers.

SYNTHESIS 1 (COMPOUND NO. 6)

Glycidyl methacrylate (142 g), trimethylamine hydrochloride (96 g), benzyl alcohol (240 g) and hydroquinone (0.1 g) were reacted with stirring at 60° C. for 70 minutes, and the reaction mixture was poured into acetone to precipitate crystals. The crystals were filtered off and recrystallized from ethanol to yield 150 g of a monomer of the following structure:

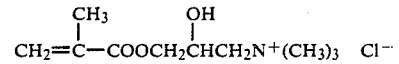

Melting point: 183° C.

Analysis: Calculated: C 50.60; H 8.48; N 5.90; Cl 14.83. Found: C 49.14; H 8.60; N 5.75; Cl 15.28.

The above monomer (23.8 g) were dissolved in 60 cc of methanol and to the resulting solution was added 0.1 g of azobisisobutyronitrile to conduct a polymerization reaction for 4 hours in a stream of nitrogen. The reaction mixture was poured into acetone to precipitate a white solid polymer. After drying under reduced pressure, it weighed 22.9 g. The specific viscosity of its 1% aqueous solution was 1.50 at 30° C.

SYNTHESIS 2 (COMPOUND NO. 12)

Glycidyl methacrylate (142 g), pyridine hydrochloride (115.5 g), benzyl alcohol (260 g) and hydroquinone (0.1 g) were reacted at room temperature for 8 hours with stirring to produce a uniform solution. This solution was allowed to stand at room temperature for 12 hours. The crystals precipitated upon addition of ether were collected, washed with acetone and recrystallized from ethanol. Thus, there was obtained 185 g of a monomer of the formula:

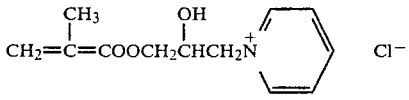

Melting point: 165° C.

Analysis: Calculated: C 56.00; H 6.32; N 5.44; Cl 13.78. Found: C 55.79; H 6.53; N 5.26; Cl 13.91.

To the solution of 25.7 g of the above monomer and 3.5 g of N-vinyl-2-pyrrolidone in 70 cc of methanol was added 0.1 g of azobisisobutyronitrile and the resulting mixture was heated to polymerize at 65° C. for 4 hours in a stream of nitrogen. The white solid polymer which was precipitated when the mixture was poured into acetone was dried under reduced pressure (29.0 g). The specific viscosity of the 1% aqueous solution (at 30° C.) was 2.35.

SYNTHESIS 3 (COMPOUND NO. 16)

$\beta$-diethylaminoethyl methacrylate (185 g) and azobisisobutyronitrile (1.6 g) were polymerized in 1,000 cc of methanol for 5 hours at 70° C. with stirring in a stream of nitrogen to produce a viscous solution of a polymer. To this solution was added 12.6 g of dimethyl sulfate in 500 cc of methanol and they were reacted at 60° C. for 3 hours. The reaction solution was poured into 5 l of ether to precipitate the crude polymer which was then dried under reduced pressure to yield 301 g of a white solid polymer. Its 1% aqueous solution showed 1.90 of specific viscosity at 30° C.

The molecular weight of the mono- or co-polymers used in the present invention ranges from 5,000 to 200,000, and is preferably 10,000–50,000. The co-polymerization ratio is preferably such that each of the co-polymerization components of the above general formula constitutes 5% or more by mole; this also applies to the case where the present mono- or co-polymers are used as mixtures with other compatible resins.

In order to provide an interfacelayer comprising the above mono- or co-polymers between a substrate and a photoconductive layer, the mono- or co-polymers or their mixtures with compatible resins may be applied on a conductive or insulating substrate in the form of a solution in an appropriate organic solvent such as methyl alcohol, ethyl alcohol or propyl alcohol. The interfacelayer on the conductive substrate have the above-mentioned effects 1–5 inherent to the interfacelayer of the present invention. In this case, the surface specific resistance of the interfacelayer is preferably below $10^{12}\Omega$, and normally its thickness, though not critical, is preferably 0.01–8$\mu$.

The interfacelayer on the insulating substrate may be made used has conductive when it is in low resistance, and can have both functions of interfacelayer and conductive layer. In this case, the surface specific resistance of the interfacelayer is preferably below $10^{10}\Omega$, and normally its thickness is preferably within the range of 0.5–15$\mu$, though this is not critical.

The present invention is further illustrated with the following examples. These examples, however should not be construed to limit the invention thereto.

EXAMPLE 1

A mixture of 10 g of high photosensitive cadmium sulfide fine particles and 7 g of alkid resin J-555 (produced by Dainippon Ink Corp.; solid content, 50%) in 6 ml of butyl acetate was subjected to supersonic dispersion.

The resulting photosensitive liquid dispersion was applied with a wire bar coater on a 100$\mu$ thick polyester film, which is a temporary substrate to be stripped off in the last step, to provide after drying a coating of 25$\mu$ thick on the film. The coating was dried and thermally treated at 140° C. for 1 hour, and on this coating was applied 10% solution of a copolymer (Compound No. 9), which was prepared by polymerizing n-butyl acrylate and Glommer-Q (produced by Nippon Yushi Co.) of 2-hydroxy-3-trimethylaminopropyl methacrylate chloride incorporated therein at a molar ratio of 1:1, in methyl alcohol by dipping followed by drying to form an interfacelayer. A mixture of conductive carbon black fine powders, alkid resin J-555 and xylene was milled by a ball mill to yield a uniform liquid dispersion, and this dispersion was applied on the interfacelayer as conductive layer and dried at 130° C. for 2 hours.

In addition, a complex film composed of a 50$\mu$ thick polyester film laminated with a 50$\mu$ thick polyethylene film was mounted by laminating on the conductive layer as the substrate of the photoconductive plate.

Last, the polyester film, which was the temporary substrate, was stripped off to provide a photosensitive material having a flat and smooth photosensitive surface. This material was employed as a sample of the photosensitive material of the present invention.

Separately, a comparative sample of the present invention was similarly prepared except that the interfacelayer was omitted.

The above two samples were cut into a size of 36.4 cm by 25.7 cm, and set in a repeated transfer type electrophotography copier equipped with a magnetic brush development apparatus. In a continuous copying test at a rate of 20 sheets per minute, the sample of the present invention produced an image of excellent contrast and tone without fog even on the 8,000th sheet.

In contrast to the above, the comparative sample caused formation of many white spots on the sheet from on about the 2,000th sheet probably due to insulation breakdown resulting from corona current occurred in corona charging, and lowering of the image density.

EXAMPLE 2

A 10% solution of the co-polymer of the above-mentioned Glommer-Q and vinyl acetate in a molar ratio of 1:1 (Compound No. 10) was applied by dipping on a 200μ thick aluminum plate to provide after drying a 5μ thick coating on the plate. Thus an interfacelayer was formed.

Next, a photosensitive liquid of 10 g of high sensitive cadmium sulfide fine particles, 7 g of alkid resin J-555 and 6 ml of butyl acetate, which was prepared by supersonic dispersion, was applied with a wire bar on the above interfacelayer to provide after drying 25μ thick coating on the interfacelayer. And this coating was thermal treated at 140° C. for 1 hour, and thus a photosensitive material was formed. This material was employed as a sample of the photosensitive material of the present invention.

Separately, a comparative sample was similarly prepared except that the interfacelayer was not provided.

The above two samples were cut into a size of 36.4 cm by 25.7 cm, and were tested as in Example 1. The result showed that the sample of the present invention produced images of excellent tone without fog even after as many as 20,000 sheets were copied. In contrast to this result, images obtained on the comparative sample were fogged from the start, and many white spots were produced on the 5,000th sheet due to insulation breakdown.

EXAMPLE 3

A 10% solution of the co-polymer of the above-mentioned Glommer-Q and styrene in a molar ratio of 1:1 (Compound No. 11) was applied by dipping on a 200μ thick aluminum plate to provide after drying a coating 3μ thick on the plate as interfacelayer. Then a mixture of 10 g of zinc oxide Sazex-4000 (produced by Sakai Chemicals Ltd.) and 25 g of silicone resin KR-211 (produced by Shin-etsu Chemicals Ltd.) in 7 ml of toluene was subjected to supersonic dispersion to prepare a photosensitive liquid. The photosensitive liquid was applied with a wire bar on the interfacelayer to provide after drying a 15μ thick coating. Thus, a sample of the photosensitive material of the present invention was prepared.

Separately, a photosensitive material without the interfacelayer was prepared as a comparative sample.

The two samples were cut into a size of 36.4 cm by 25.7 cm and were tested as in Example 1, respectively. When the sample of the present invention was tested, images of excellent tone without fog were produced even after as many as 500 sheets were copied. However, on comparative sample, many white spots due to insulation breakdown were produced on about the 70th sheet.

EXAMPLE 4

On a 175μ thick film (Mylar: a product made by E. I. du Pont), which is a temporary substrate as in Example 1, was applied a photosensitive liquid of the following formula to form after drying and thermal processing a 23μ thick coating as photosensitive layer.

| The photosensitive liquid | |
|---|---|
| Cadmium sulfide with an average particle size of 1μ | 10 g |
| Alkid resin EZ-3651 (Dainippon Ink Corp.) | 6 g |
| Melamine resin G-821 (Dainippon Ink Corp.) | 1 g |
| Butyl acetate | 7 ml |

A 10% solution of the co-polymer of 2-hydroxy-3-pyridyl-propylmethacrylate chloride and butyl acrylate in a molar ratio of 1:4 (Compound No. 14) was applied on the photosensitive layer to form an interfacelayer about 5μ thick on the layer.

Further on the interfacelayer, a liquid dispersion prepared by dispersing a mixture of conductive carbon fine powders, alkid resin J-555 and xylene with a ball mill was applied as conductive layer and dried and thermally treated at 120° C. for 1 hour. A further 50μ thick polyester-polyethylene sheet for laminating was laid on the conductive layer as substrate. The Mylar film as the temporary support was stripped off to provide the thus prepared photosensitive material with a flat and smooth surface as a sample of the present invention.

Separately, a comparative sample without the interfacelayer of the present invention was similarly prepared.

The thus prepared two types of samples were cut into a size of 36.4 cm by 25.7 cm and were tested as in Example 1, respectively. In a continuous copying test with 10,000 sheets, the sample of the present invention continuously produced unfogged and sharp images with good contrast, almost of the same quality as the first image. The comparative sample caused production of many white spots due to insulation breakdown on about the 3,000th sheet in addition to lowering in contrast. The first image based on the sample of the present invention was less fogged and in better contrast than that on the comparative sample.

In order to compare the electric properties of the present sample with those of the comparative sample, the potential properties of these two samples were measured using a rotary disc type electrometer. The data are tabulated in Table 1 below.

TABLE 1

| | Potential | |
|---|---|---|
| Sample | Initial Potential*1 | Residual Potential*2 |
| Present Sample | 468 V | 62 V |
| Comparative Sample | 398 V | 80 V |

*1Potential after 5 seconds after charging at 6,000 V with a corotron charger.
*2Potential after 20 lux . sec. exposure to tungsten light.

It is apparent from the data in Table 1 that the properties of the present sample are superior to those of the comparative sample.

EXAMPLE 5

A 10% solution of the copolymer of β-methacryloxyethyl dimethyl ethyl ammonium chloride and hexyl acrylate (3:7) (Compound No. 21) was applied on a 0.2 mm thick aluminum plate with a flat and smooth surface and dried to form an interfacelayer about 4μ thick on the plate. Further, on the interfacelayer was applied a photosensitive liquid of the following formula to provide after drying a coating about 20μ thick, dried and subjected to thermal processing. Thus there was obtained a photosensitive material of the present invention as a sample of the present invention.

| The photosensitive liquid | |
|---|---|
| High photosensitive cadmium sulfide with an average particle size of about 1μ | 10 g |
| Thermosetting acrylic resin RE-377 (Mitsubishi Tayon Inc., Ltd.) | 6 g |
| Fluorine base surfactant C-431 (3M Inc., Ltd.) | 0.06 g |
| Butyl acetate | 7 ml |

Separately, following the above procedure, but not providing the interfacelayer, another photosensitive material was prepared as a comparative sample.

The two samples were cut into a size of 36.4 cm by 25.7 cm, and then tested similarly as in Example 1. In the test using the sample of the present invention, the image even on the 8,000th sheet was little fogged, of good tone and sharp as the first image was. But, the comparative sample caused production of many white spots and lowering of contrast on about the 3,000th sheet. Further, the first copied image on the sample of the present invention was less rough and fogged, and in better contrast than that on the comparative sample.

EXAMPLE 6

On a 100μ thick film (Mylar: a product made by E. I. du Pont), which is a temporary substrate as in Example 1, was applied a photosensitive liquid of the following formula to form after drying a 20μ thick coating. This coating was dried and thermally processed to produce the first photosensitive layer.

| The photosensitive liquid | |
|---|---|
| Cadmium sulfide with an average particle size of 1μ | 10 g |
| Alkid resin J-555 | 6 g |
| Fluorine base surfactant FC-431 | 0.06 g |
| Butyl acetate | 6 ml |

Further, a photosensitive liquid of the following formula was applied to provide a coating 25μ thick including the thickness of the first photosensitive layer, and dried followed by thermal processing. This coating is the second photosensitive layer.

| The photosensitive liquid | |
|---|---|
| Cadmium sulfide with an average particle size of 1μ | 10 g |
| Alkid resin J-555 | 6 g |

-continued

| The photosensitive liquid | |
|---|---|
| Butyl acetate | 6 ml |

A 10% solution of the copolymer of 2-hydroxy-3-pyridylpropyl acrylate chloride and vinyl acetate (Compound No. 15) in methyl alcohol was applied on the second photosensitive layer and dried. Thus there was formed an about 7μ thick interfacelayer.

Further on the interfacelayer, a liquid dispersion prepared by dispersing a mixture of conductive carbon fine powders, alkid resin J-555 and xylene with a ball mill was applied as conductive layer and dried and thermally treated at 120° C. for 1 hour. A further coating 500μ thick after drying as support was provided on the conductive layer by application of a solution of polyvinyl butyral resin Esrec BM-2 (produced by Sekisui Chemicals Ltd.) by Giesser coating, and was drying. Last, the polyester film as the temporary support was stripped off to provide the thus obtained photosensitive material with a flat and smooth surface as a sample of the present invention.

Separately, a comparative sample without the interfacelayer of the present invention was similarly prepared.

The two types of samples were cut into a size of 36.4 cm by 25.7 cm and were tested as in Example 1, respectively. In a continuous copying test with 20,000 sheets, the sample of the present invention continuously produced unfogged and sharp images with good contrast, almost of the same quality as the first image. But, in the test using the comparative sample, many white spots due to insulation breakdown were produced on the sheets from on about the 5,000th sheet accompanied by lowering in contrast. The first image copied based on the sample of the present invention was less rough and fogged, and in better contrast than that copied based on the comparative sample.

We claim:

1. A binder-type electrographic photosensitive plate which possesses stable electrical and physical properties and which is used to make multiple copies by a transfer process, comprising: an electroconductive substrate which is a metal plate or a plastic film having an electrically conductive layer containing carbon black power thereon, a photosensitive layer and an interface layer positioned between the electroconductive substrate and the photosensitive layer, said interface layer containing as an essential ingredient a mono- or co-polymer comprised of units of the formula:

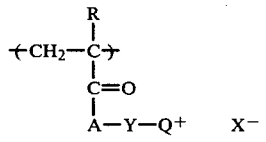

wherein R is hydrogen or methyl; A is

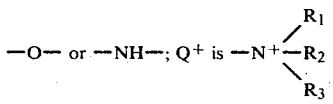

wherein $R_1$, $R_2$, and $R_3$ are each lower alkyl, phenyl, or benzyl, with $R_2$ and $R_3$ optionally being joined together to form a ring, or

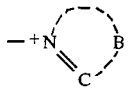

wherein B is a non-metallic atom selected from the group consisting of carbon, nitrogen, and sulfur, necessary to form a 5–6 membered heterocyclic nucleus with the $-N^+=C-$ group; $X^-$ is an anion, and Y is a substituted or unsubstituted alkylene group; and in which the molecular weight of said mono- or co-polymer ranges from 5000–200,000.

2. The electrophotography photosensitive plate of claim 1, in which the interface layer contains 5% to 60% by mole of the mono- or the co-polymer of the quaternary ammonium derivative.

3. The electrophotographic photosensitive plate of claim 1, wherein said mono- or co-polymer has a molecular weight in the range of 10,000–50,000.

4. The electrophotographic photosensitive plate of claim 1, wherein the interface layer of said photosensitive plate has a surface specific resistance less than $10^{12}$ ohms.

5. The electrophotographic photosensitive plate of claim 1, wherein the thickness of said interface layer ranges from 0.01–8 microns.

6. The electrophotographic photosensitive plate of claim 1, wherein said interface layer is a copolymer of said unit copolymerized with acrylamide, N-vinylpyrrolidone, N,N-dimethylacrylamide, diacetone acrylamide, methyl acrylate, methyl methacrylate, vinyl acetate, styrene or vinyl butyral.

* * * * *